United States Patent [19]

Brazier et al.

[11] Patent Number: 4,708,638

[45] Date of Patent: Nov. 24, 1987

[54] FLUID FUEL FIRED BURNER

[75] Inventors: John F. Brazier, Wembley; Alan H. Young, Waterlooville; John E. Viney, Chichester; Gordon W. Sutton, Bisley, all of Great Britain

[73] Assignee: Tauranca Limited, Hampshire, United Kingdom

[21] Appl. No.: 832,456

[22] Filed: Feb. 21, 1986

[30] Foreign Application Priority Data

Feb. 21, 1985 [GB] United Kingdom ..... 8504475
Nov. 7, 1985 [GB] United Kingdom ..... 8527477

[51] Int. Cl.[4] ..... F23C 9/00; F23L 1/00

[52] U.S. Cl. ..... 431/116; 431/182; 431/188

[58] Field of Search ..... 431/9, 115, 116, 182, 431/183, 187, 4, 188

[56] References Cited

U.S. PATENT DOCUMENTS 3,413,069 11/1968 Walsh ..... 431/116 X
3,741,166 6/1973 Bailey ..... 431/116 X
3,838,652 10/1974 Schol ..... 431/116 X
4,230,445 10/1980 Janssen ..... 431/116
4,575,332 3/1986 Oppenberg et al. ..... 431/9

FOREIGN PATENT DOCUMENTS 0022134 2/1977 Japan ..... 431/116
0152231 11/1979 Japan ..... 431/115
0023869 2/1980 Japan ..... 431/116
0026308 2/1982 Japan ..... 431/115

*Primary Examiner*—Margaret A. Focarino
*Attorney, Agent, or Firm*—Rosen, Dainow & Jacobs

[57] ABSTRACT

The flame temperature of a fluid fuel fired burner (10) is reduced by mixing flue gas (35) with the combustion air supply (34) before introduction of the fuel and combustion take place. The NOX produced by the process of combustion is thereby reduced. The flue gas (35) may also be induced from the furnace remote from the flame zone of the burner (10) such that the flame is not disturbed. A venturi (21) may be used to induce the flue gas (35) from the furnace.

7 Claims, 1 Drawing Figure

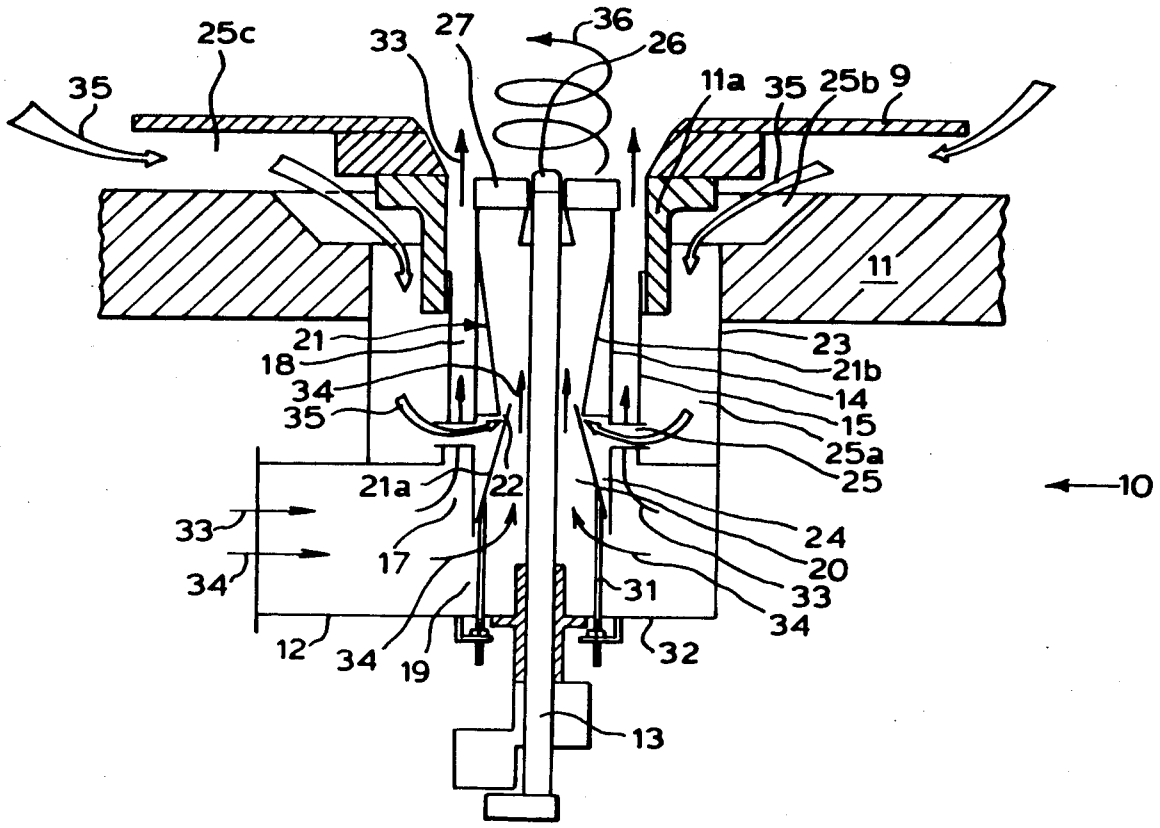
10
9
25b
35
11a
26
36
27
33
25c
35
11
23
21b
14
15
25a
25
24
20
33
34
32
31
13
22
21a
17
19
34
12
21
18
34
35
33
34

FLUID FUEL FIRED BURNER

BACKGROUND OF THE INVENTION

This invention relates to a fluid fuel fired burner.

It has long been established that the NOX (nitrogen oxides) produced by the process of combustion of a fuel in a furnace can be controlled and reduced by reducing flame temperature. It is accepted that it is necessary, when taking measures to reduce flame temperature, also to be able to keep control of flame profile and be able to completely combust the fuel with the minimum of excess air, thus maintaining high efficiency low excess air combustion with low pollutants as well as low NOX discharge. The hottest part of the flame is the primary flame and it is important therefore to maintain a stable and controlled primary flame to ensure a controlled total flame, and thus controlled pollutant discharges.

SUMMARY OF THE INVENTION

According to the invention there is provided a fluid fuel fired burner having a combustion air supply passage, means for introducing flue gas to the combustion air and a swirler for mixing combustion air and fuel, characterised in that the flue gas is introduced to the combustion air upstream of the swirler. This arrangement enhances the mixing of the inert flue gas with the combustion air before fuel is introduced and combustion takes place. The temperature of the flame is reduced, thereby reducing NOX formation. The fuel is introduced immediately downstream of the swirler, thus mixing the fuel with the combustion air and increasing the stability of the flame.

A preferred feature of the invention is the provision of a venturi in the combustion air supply passage upstream of the swirler. The venturi induces the flow of flue gas into the combustion air supply passage via ducts connecting with the firing face of the furnace. An advantage of the use of a venturi is that no moving parts are required to inspirate the flue gas; in the absence of a venturi, a fan or similar means would be required.

A further preferred feature is the positioning of the inlets to the ducts via which the flue gas is induced into the combustion air supply passage, remote from the flame of the burner. If the flue adjacent the flame is induced to flow into the ducts, the flame will be disturbed and stability will be lost. If flue gas is induced from a remote part of the furnace, no disturbance is caused. This is preferably achieved by the provision of a spreader plate, preferably of ceramic or refractory construction, a passageway being formed between the spreader plate and the firing face of the furnace. Flue gas flow is then induced around the periphery of the spreader plate, along the passageway and into the ducts. The inlet means may also be used for inducing the flow of other gases, e.g. steam, nitrogen, into the combustion air stream.

It is therefore possible to take inert flue gas (i.e. products of combustion) from, for example, the base of the furnace and provide it where needed to lower primary flame temperature and hence the NOX generated, whilst maintaining flame shape and keeping other pollutants at a minimum. Moreover, this can be achieved without an additional fan to recirculate the flue gas and therefore at little or no extra running cost.

In addition to the technical operational value of such a burner it is well suited for application to all types of furnace with space limitations and with a requirement of easy control throughout its operational range.

The invention is particularly suited to liquid (e.g. oil) fired burners because of the higher NOX produced due to the nitrogen content of the fuel, but can be applied also to gas fired burners and (combination) oil and gas fired burners.

BRIEF DESCRIPTION OF THE DRAWINGS

An embodiment of the invention incorporating these three features will now be described with reference to the accompanying drawing which is a schematic sectional view of a fluid fuel burner according to the invention.

DETAILED DESCRIPTION OF THE DRAWINGS

Referring now to the drawing, the burner 10 shown therein is attached to the firing face 11 of a furnace. The burner 10 comprises a windbox 12, a fuel pipe 13 supported by the burner front plate 32, and two concentric sleeves 14 and 15 which extend through one wall of the windbox and which are connected together by vanes or bars (not shown). The outer sleeve 15 is attached as shown to the face 11 of the furnace. The sleeves 14 and 15 define therebetween an air inlet 17 leading to an axially directed annular passage 18 for secondary combustion air. A primary air inlet 19 is defined between the end of the inner sleeve 14 projecting into the windbox 12 and one wall thereof, the inlet 19 leading to an axially directed annular primary air passage 20 surrounding the fuel pipe 13.

A fuel supply nozzle 26 is provided at the free end of the fuel pipe 13 and a swirler 27 for imparting a rotary motion to the primary and secondary combustion air and induced flue gas is mounted on the fuel pipe 13 adjacent to the fuel supply nozzle 26. Mixing of the gases and fuel supplied via the nozzle 26 is thereby enhanced, giving the flame produced by the burner 10 stability.

A venturi 21 which serves as a flue gas ejector is provided in the passage 20. The venturi 21 has convergent and divergent parts **21*a* and 21*b* respectively. The upper end of the convergent part 21*a* extends beyond the lower end of the divergent part 21*b* and into the latter to define an annular ejector opening 22 between the parts 21*a* and 21*b***.

The broader end of the divergent part **21*b* is secured to the inner sleeve 14 and the broader end of the convergent part 21*a* is supported by an adjustment rod 31**.

A chamber 24 defined between the venturi 21 and the inner sleeve 14 communicates with the firing end of the furnace through a plurality, e.g. six, of ducts 25 which are equi-angularly spaced around the axis of the burner 10.

Each duct 25 comprises a passage **25*a* defined between an outer wall 23 of the burner 10 and the outer sleeve 15, and aligned with a through-hole 25*b* provided in the firing face 11 of the furnace. The firing face 11 may be of QUARL brick. Above the entrance to the through-hole 25*b* is supported a spreader plate 9 extending radially away from the axis of the burner 10 such that a further passage 25*c* is formed between the firing face 11 and the spreader plate 9. In this way, the inlet to the duct 25 is made remote from the burner 10** and the flame profile is undisturbed by the removal of flue gases from the firing end of the furnace.

Combustion air indicated by arrows 33,34 is supplied to windbox 12 by a fan (not shown) and thence to the primary and secondary air inlets 19 and 17 respectively.

Primary air indicated by arrows 34 flowing through the venturi 21 will induce the flow of flue gas indicated by arrows 35 from the firing end of the furnace into the venturi 21 via the ducts 25, the chamber 24 and the ejector opening 22. The flue gas 35 and primary combustion air 34 pass through the swirler 27, the motion thereof enhancing the mixing of the flue gas 35 with the primary combustion air 34. Immediately downstream of the swirler 27, fuel is emitted from the fuel supply nozzle 26 and is introduced to the mixture of flue gas 35 and primary combustion air 34. The secondary combustion air 33 is also introduced thereto immediately downstream of the swirler 27. The combustion air (33,34), the flue gas 35 and the fuel are mixed by the swirler 27 and take a rotating path indicated by arrow 36. The mixing of the flue gas 35 with the primary combustion air 34 and of the fuel with the gases 33,34,35 increases the stability of the flame produced by the burner 10.

The rate of flow of the induced flue gas may be varied to suit requirements by altering the size of the ejector gap 22 via the adjustment rod 31. The percentage of induced flue gas may be varied in this way between approximately 3% and 9% by volume of the primary air flow although a percentage of about 7% by volume has been found to be advantageous. Such a quantity of inert flue gas retards the primary flame combustion while still maintaining control and stability of the flame. The fact that combustion is retarded and controlled results in a lower flame temperature and thus a reduction of NOX production through primary flame combustion.

In addition to the flue gas induced into the combustion air as aforesaid, flue gas may be introduced into the main combustion air supply using a fan. Thus the total percentage of flue gas in the combustion air is increased to between 12% and 27% by volume of the total air flow, giving a lower reduction of NOX produced by combustion through flame temperature reduction, but having the disadvantages of more moving parts and higher energy consumption.

Burners designed to operate under low load conditions only may be adequately provided with a single air supply passage incorporating a venturi. The secondary air supply may be omitted.

The burner described above may also be used in conjunction with furnace stage combustion and employing sub-stoichiometric burner combustion principles.

We claim:

1. A fluid fuel fired burner comprising a primary combustion air supply passage, a flame zone located downstream of said primary combustion air supply passage for receiving combustion air therefrom, means for introducing flue gas to said primary combustion air supply passage, means for supplying fuel to said combustion air, a swirler located downstream of said flue-gas introduction means and upstream of said flame zone for stabilising a flame therein and for mixing said flue gas and combustion air passing therethrough, a venturi located in said primary combustion air supply passage upstream of said swirler for inducing flue gas into said primary combustion air supply passage, wherein said flue-gas introduction means comprises at least one flue-gas supply passage communicating with said venturi and having a flue-gas inlet remote from said flame zone, and a spreader plate located adjacent said flame zone for defining said flue-gas inlet remote from said flame zone whereby the flue gas induced to flow into said primary combustion air-supply passage does not disturb the stability of said flame.

2. The fluid fuel fired burner of claim 1, further comprising a secondary combustion-air passage for supplying secondary combustion air to the flame zone.

3. The fluid fuel fired burner of claim 2, wherein said venturi comprises a convergent part, a divergent part and at least one duct located between said parts and communicating with said at least one fluegas supply passage, one of said parts being movably supported on an adjustment means for movement with respect to the other of said parts, whereby the size of said at least one duct can be varied.

4. A fluid fuel fired burner comprising a primary combustion air supply passage, a flame zone located downstream of said primary combustion air supply passage for receiving combustion air therefrom, means for introducing flue gas to said primary combustion air supply passage, means for supplying fuel to said combustion air, a swirler located downstream of said flue-gas introduction means and upstream of said flame zone for stabilising a flame therein and for mixing said flue gas and combustion air passing therethrough, and a venturi located in said primary combustion air supply passage upstream of said swirler for inducing flue gas into said primary combustion air supply passage, wherein said flue-gas introduction means comprises at least one flue-gas supply passage communicating with said venturi and having a flue-gas inlet means to the flue-gas supply passage remote from said flame zone, and wherein said venturi comprises a convergent part, a divergent part and at least one duct located therebetween and communicating with said flue-gas supply passage, at least one of said parts being movably supported on an adjustment means for variation of the size of said duct, the flow of flue gas being regulated thereby whereby the flue gas induced to flow into said primary combustion air-supply passage does not disturb the stability of said flame.

5. A fluid fuel fired burner comprising a primary combustion air supply passage, a flame zone located downstream of said primary combustion air supply passage for receiving combustion air therefrom, means for introducing flue gas to said primary combustion air supply passage, means for supplying fuel to said combustion air, a swirler located downstream of said flue-gas introduction means and upstream of said flame zone for stabilising a flame therein and for mixing said flue gas and combustion air passing therethrough, and a venturi located in said primary combustion air supply passage upstream of said swirler for inducing flue gas into said primary combustion air supply passage, wherein said flue-gas introduction means comprises at least one flue-gas supply passage communicating with said venturi and having a flue-gas inlet means to the flue-gas supply passage remote from said flame zone and wherein said flue gas inlet means comprises means separating and spacing apart said induced flue gas supply passage from said flame zone whereby said flue gas inlet means is sufficiently remote from said flame zone that the stability of said flame is not disturbed.

6. Apparatus according to claim 1 wherein said primary air passage is defined outwardly by walls which walls also partially define and separate said flue gas supply passage from said primary air passage and from said flame zone, whereby said flue gas inlet means is sufficiently remote from said flame zone that the stability of the flame is not disturbed.

7. A fluid fuel fired burner comprising a primary combustion air supply passage, a flame zone located downstream of said primary combustion air supply passage for receiving combustion air therefrom, means for introducing flue gas to said primary combustion air supply passage, means for supplying fuel to said combustion air, a swirler located downstream of said flue-gas introduction means and upstream of said flame zone for stabilising a flame therein and for mixing said flue gas and combustion air passing therethrough, and a venturi located in said primary combustion air supply passage upstream of said swirler for inducing flue gas into said primary combustion air supply passage, wherein said flue-gas introduction means comprises at least one flue-gas supply passage communicating with said venturi and having a flue-gas inlet means to the flue-gas supply passage remote from said flame zone and wherein said flue gas inlet means forms a barrier between said induced flue gas and said flame zone, said induced flue gas entering said flue-gas inlet means from an area sufficiently remote from said flame zone that the stability of said flame is not disturbed.

* * * * *